US009697977B2

(12) United States Patent
Yang et al.

(10) Patent No.: US 9,697,977 B2
(45) Date of Patent: Jul. 4, 2017

(54) MAGNETRON AND HIGH-FREQUENCY HEATING APPARATUS HAVING THE SAME

(71) Applicant: SAMSUNG ELECTRONICS CO., LTD., Suwon-si (KR)

(72) Inventors: Seung Chul Yang, Suwon-si (KR); Dang Won Kim, Suwon-si (KR); Hak Jae Kim, Suwon-si (KR); Ki Whan Kim, Geoje-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 323 days.

(21) Appl. No.: 14/494,689

(22) Filed: Sep. 24, 2014

(65) Prior Publication Data

US 2015/0170866 A1 Jun. 18, 2015

(30) Foreign Application Priority Data

Dec. 18, 2013 (KR) ..... 10-2013-0158481

(51) Int. Cl.
*H05B 6/64* (2006.01)
*H05B 6/72* (2006.01)
(Continued)

(52) U.S. Cl.
CPC ..... *H01J 23/10* (2013.01); *H01J 23/005* (2013.01); *H01J 23/11* (2013.01); *H01J 23/20* (2013.01);
(Continued)

(58) Field of Classification Search
CPC ..... H01J 23/005; H01J 23/10; H01J 23/11; H01J 23/20; H01J 25/50; H01J 25/587; H05B 6/66
(Continued)

(56) References Cited

U.S. PATENT DOCUMENTS 3,443,150 A * 5/1969 Staats ..... H01J 25/58 315/39.51
4,163,175 A * 7/1979 Tashiro ..... H01J 23/15 315/39.51
(Continued)

FOREIGN PATENT DOCUMENTS

| | | |
|---|---|---|
| EP | 1562218 | 8/2005 |
| EP | 2037482 | 3/2009 |
| EP | 2237304 | 10/2010 |

OTHER PUBLICATIONS

Extended European Search Report dated Apr. 28, 2015 in European Application No. 14189243.0.

*Primary Examiner* — Sang Y Paik
(74) *Attorney, Agent, or Firm* — Staas & Halsey LLP

(57) ABSTRACT

A magnetron includes a yoke, an anode unit including an anode cylinder, radially arranged vanes, and first and second pole pieces at both sides of the anode cylinder, a cathode unit having a filament spaced apart from the vanes, and an output unit having an antenna lead connected to one vane to radiate high-frequency microwaves. The first pole piece includes a first flat portion, a slope at an inner side of the first flat portion, a second flat portion at an inner side of the slope and having a diameter of 9.5~10.5 mm, a first hole formed in the second flat portion and having a diameter of 8~8.2 mm, and a second hole formed in the slope for penetration of the antenna lead. The magnetron achieves higher and stabilized efficiency, restricted oscillation efficiency variation, lower energy consumption, and improved load stability without deterioration of oscillation efficiency.

18 Claims, 16 Drawing Sheets

(51) Int. Cl.

| | |
|---|---|
| ***H01J 23/10*** | (2006.01) |
| ***H05B 6/66*** | (2006.01) |
| ***H01J 25/50*** | (2006.01) |
| ***H01J 23/00*** | (2006.01) |
| ***H01J 23/20*** | (2006.01) |
| ***H01J 23/11*** | (2006.01) |
| ***H01J 25/587*** | (2006.01) |

(52) U.S. Cl.
CPC ..... *H01J 25/50* (2013.01); *H01J 25/587* (2013.01); *H05B 6/66* (2013.01)

(58) Field of Classification Search
USPC ..... 219/678–680, 736–750, 761; 315/39.51–39.77
See application file for complete search history.

(56) References Cited

U.S. PATENT DOCUMENTS

| | | | | |
|---|---|---|---|---|
| 5,177,403 | A * | 1/1993 | Kawaguchi | H01J 23/54 315/39.53 |
| 2002/0175627 | A1* | 11/2002 | Murao | H01J 23/15 315/39.51 |
| 2006/0238129 | A1* | 10/2006 | Ochiai | H01J 23/15 315/39.51 |
| 2007/0151847 | A1* | 7/2007 | Lee | H01J 23/05 204/298.19 |
| 2007/0296515 | A1* | 12/2007 | Kato | H01J 23/10 332/132 |
| 2009/0066252 | A1* | 3/2009 | Higashi | H01J 25/50 315/39.51 |

* cited by examiner

FIG. 12

| DIVISION OF CHOKE COILS | LOAD STABILITY MoB | | |
|---|---|---|---|
| | OSCILLATION EFFICIENCY Π(%) | LOAD STABILITY MoB (mA) | CATHODE BACK BOMBARDMENT Δ If (mA) |
| CONVENTIONAL CHOKE COIL | 78.0 | 400 | 1.4 |
| INDUCTOR OF THE PRESENT EMBODIMENT AND MAGNETIC SUBSTANCE CORE OF Ø 4.0 x L 17.0 | 77.5 | 510 | 1.1 |
| INDUCTOR OF THE PRESENT EMBODIMENT AND MAGNETIC SUBSTANCE CORE OF Ø 4.0 x L 15.0 | 78.1 | 550 | 1.0 |
| INDUCTOR OF THE PRESENT EMBODIMENT AND MAGNETIC SUBSTANCE CORE OF Ø 4.0 x L 13.0 | 77.2 | 470 | 1.2 |
| CHARACTERISTICS EVALUATION STANDARDS OF MAGNETRON | HIGH VALUE IS GOOD | LARGE VALUE IS GOOD | SMALL VALUE IS GOOD |

FIG. 14

| DIVISION | WELD MATERIAL OF OBJECT ELEMENT (THICKNESS: 2~4㎛) | | | OSCILLATION EFFICIENCY (%) | | | |
|---|---|---|---|---|---|---|---|
| | FIRST POLE PIECE | FIRST SEALING MEMBER | FIRST NOISE REMOVER | SAMPLE① | SAMPLE② | SAMPLE③ | SAMPLE④ |
| RELATED ART | NICKEL | NICKEL | NICKEL | 72.5 | 72.2 | 72.6 | 72.43 |
| TEST A | COPPER | NICKEL | NICKEL | 72.2 | 72.5 | 72.4 | 72.37 |
| TEST B | NICKEL | COPPER | NICKEL | 72.5 | 72.3 | 72.6 | 72.47 |
| TEST C | NICKEL | NICKEL | COPPER | 73.5 | 73.6 | 73.3 | 73.47 |
| TEST D | COPPER | COPPER | COPPER | 73.6 | 73.3 | 73.7 | 73.53 |

MAGNETRON AND HIGH-FREQUENCY HEATING APPARATUS HAVING THE SAME

CROSS-REFERENCE TO RELATED APPLICATIONS

This application claims the priority benefit of Korean Patent Applications No. 10-2013-0158481, filed on Dec. 18, 2013 in the Korean Intellectual Property Office, the disclosure of which is incorporated herein by reference.

BACKGROUND

1. Field

The following description relates to a high-efficiency magnetron and a high-frequency heating apparatus having the same.

2. Description of the Related Art

Generally, a magnetron is a device in which a flow of electrons is controlled under the influence of a magnetic field to generate extremely short radio waves. Such a magnetron is used in high-frequency heating apparatuses for cooking, such as microwave ovens, or other apparatuses, such as particle accelerators, radar, and the like.

The most common magnetron is a magnetron included in high-frequency heating apparatuses for cooking in homes or restaurants.

A conventional magnetron basically includes an anode unit surrounded by an outer yoke and a plurality of cooling fins, a cathode unit installed in the center of the anode unit, an output unit to radiate radio waves, an input unit for power input, and an upper magnet and a lower magnet installed respectively to the top and bottom of the anode unit to create a magnetic field in a working space between the anode unit and the cathode unit.

The anode unit includes a hollow anode cylinder, a plurality of vanes radially arranged around the center of the anode cylinder, and upper and lower pole pieces installed respectively to the top and bottom of the anode cylinder. The cathode unit includes a coil-shaped filament located in the center of the anode cylinder, and a center lead and a side lead to supply power to the filament.

The output unit includes an antenna lead having one end coupled to any one vane to outwardly transmit radio waves, and the input unit includes a plug to supply external power to the center lead and the side lead.

In the operation of the magnetron having the above-described configuration, when power is applied to the filament via the center lead and the side lead, a group of electrons is generated in the working space between the filament and the vanes. The group of electrons is spirally rotated under the influence of a strong electric field and a magnetic field created in the working space, causing radio waves to be directed to the vanes. Then, the radio waves are discharged outward via the antenna lead.

The conventional magnetron does not consider load variation, i.e. load characteristics represented as a Ricke diagram. Thus, the magnetron may achieve high efficiency under matched load causing no reflection from load of output microwave power, but may fail to achieve high efficiency due to low oscillation efficiency under mismatched load causing reflection, e.g., in a microwave oven.

In addition, development of higher efficiency and more energy saving magnetrons having a smaller tube body causes deterioration of load stability (MoB) that is an index of stable magnetron operation, which makes it impossible to maintain stable oscillation.

Moreover, to restrict unwanted harmonic noise, the output unit of the magnetron includes at least one metal cylinder coaxial with the antenna lead to construct a $\lambda/4$ type choke structure having a ¼ depth of a frequency wavelength to be restricted. However, resistance of a skin based on skin effect, determined by permeability, resistivity, and frequency of a material, causes deterioration of resonance sharpness (Q) of the $\lambda/4$ type choke structure and insufficient restriction of harmonic noise. Thus, the magnetron may be unsuitable because it does not satisfy noise standards, or may cause deterioration of microwave power of 2450 MHz due to reduced circuit efficiency caused by Joule loss (energy loss) in the metal cylinders of the $\lambda/4$ type choke structure, resulting in deterioration of oscillation efficiency.

SUMMARY

It is an aspect to provide a magnetron which may enhance oscillation efficiency, load stability, and high efficiency via adjustment of dimensions of pole pieces included in an anode unit, and a high-frequency heating apparatus having the same.

It is an aspect to provide a magnetron which may enhance oscillation efficiency, load stability, and high efficiency via adjustment of dimensions of cores of choke coils included in a filter unit, and a high-frequency heating apparatus having the same.

It is an aspect to provide a magnetron which may restrict harmonic noise by surrounding an antenna lead of an output unit with a copper plated member, and a high-frequency heating apparatus having the same.

Additional aspects of the disclosure will be set forth in part in the description which follows and, in part, will be obvious from the description, or may be learned by practice of the disclosure.

In accordance with an aspect of the disclosure, a magnetron includes a yoke, an anode unit including an anode cylinder placed in the yoke and having a working space, a plurality of vanes radially arranged about an axis of the working space, and a first pole piece and a second pole piece installed respectively at both sides of the anode cylinder, a cathode unit placed in the working space and having a filament spaced apart from the vanes, and an output unit having an antenna lead connected to any one vane among the vanes to radiate high-frequency microwaves, generated by the anode unit and the cathode unit, to the outside of the yoke, wherein the first pole piece of the anode unit includes a first flat portion, a slope formed at an inner side of the first flat portion, a second flat portion formed at an inner side of the slope and having a diameter from approximately 9.5 mm to approximately 10.5 mm, a first hole formed in the center of the second flat portion at a position corresponding to the working space and having a diameter from approximately 8 mm to approximately 8.2 mm, and a second hole formed in the slope for penetration of the antenna lead.

Each of the vanes may have a height from approximately 7.9 mm to approximately 8.1 mm.

A diameter of an inscribed circle defined by the radially arranged vanes may be from approximately 8.0 mm to approximately 8.2 mm.

The filament may have a coil form, and an outer diameter of the filament may be from approximately 3.6 mm to approximately 3.8 mm.

A distance between the antenna lead and an end of the vane to which the antenna lead is mounted may be from approximately 6.8 mm to approximately 7.2 mm.

The second pole piece of the anode unit may include a first flat portion, a slope formed at an inner side of the first flat portion, a second flat portion formed at an inner side of the slope and having a diameter from approximately 10.5 mm to approximately 11.5 mm, and a first hole formed in the center of the second flat portion at a position corresponding to the working space and having a diameter from approximately 8.4 mm to approximately 8.6 mm.

A distance between the second flat portion of the first pole piece and any one vane and a distance between the second flat portion of the second pole piece and the vane may be from approximately 1.3 mm to approximately 1.5 mm.

The cathode unit may further include a first end hat and a second end hat coupled respectively to both ends of the filament, and an outer diameter of each of the first end hat and the second end hat may be approximately 7.2 mm.

A distance between the first end hat and the second end hat may be approximately 9.0 mm.

The magnetron may further include an input unit having an input terminal connected to the cathode unit to supply power to the cathode unit, and a filter unit having a filter box to cover the input unit, a condenser penetrating the filter box, and a plurality of filters arranged in the filter box and connected between the condenser and the input unit.

Each of the filters may include a choke coil, and the choke coil may include a magnetic substance core, a first coil and a second coil wound around the magnetic substance core, a first connection portion connecting the first coil and the second coil to each other, a third coil connected to the second coil, a fourth coil located at one side of the third coil, and a second connection portion connecting the third coil and the fourth coil to each other.

The first coil and the second coil may be core type dense coils, the third coil may be an air core type dense coil, and the fourth coil may be an air core type sparse coil.

An inner diameter of the choke coil may be approximately 4.5±0.2 mm.

The magnetic substance core may have a diameter of approximately 4.0±0.2 mm, and a length of approximately 15 mm.

The first coil may have 4 turns, the first connection portion may have 1 turn, the second coil may have 3 turns, the third coil may have 2 turns, the second connection portion may have 1 turn, and the fourth coil may have 2.5 to 3 turns.

The output unit may include a metal body surrounding the antenna lead, the metal body being formed by plating an iron plate having a thickness from approximately 0.2 mm to approximately 0.3 mm with copper to a thickness of approximately 2 μm or more.

In accordance with an aspect, a magnetron includes a yoke, an anode unit including an anode cylinder placed in the yoke and having a working space, a plurality of vanes radially arranged about an axis of the working space, and a first pole piece and a second pole piece installed respectively at both sides of the anode cylinder, a cathode unit placed in the working space and having a filament spaced apart from the vanes, an output unit having an antenna lead connected to any one vane among the vanes to transmit high-frequency microwaves, generated by the anode unit and the cathode unit, to the outside of the yoke, an input unit having an input terminal connected to the cathode unit to supply power to the cathode unit, and a filter unit having a filter box to cover the input unit, a condenser penetrating the filter box, and a plurality of filters arranged in the filter box and connected between the condenser and the input unit, wherein each of the filters includes a choke coil, and wherein the choke coil includes a magnetic substance core having a diameter of approximately 4.0±0.2 mm and a length of approximately 15 mm, a first coil and a second coil wound around the magnetic substance core, a first connection portion connecting the first coil and the second coil to each other, a third coil connected to the second coil, a fourth coil located at one side of the third coil, and a second connection portion connecting the third coil and the fourth coil to each other.

The first coil and the second coil may be core type dense coils, the third coil may be an air core type dense coil, and the fourth coil may be an air core type sparse coil.

An inner diameter of the choke coil may be approximately 4.5±0.2 mm.

The first coil may have 4 turns, the first connection portion may have 1 turn, the second coil may have 3 turns, the third coil may have 2 turns, the second connection portion may have 1 turn, and the fourth coil may have 2.5 to 3 turns.

The choke coil may have an inductance from approximately 0.7 μH to approximately 0.9 μH.

The first coil, the second coil, the third coil, and the fourth coil may have a diameter of approximately 1.4 mm.

In accordance with an aspect, a high-frequency heating apparatus using high-frequency microwaves generated by a magnetron is provided, wherein the magnetron includes a yoke, a cathode unit placed in the yoke and having a filament to discharge thermo-electrons by being heated upon receiving power, an anode unit including an anode cylinder placed in the yoke and having a working space in which an electric field is created, a plurality of vanes radially arranged about an axis of the working space and spaced apart from the filament to generate a group of electrons using the thermo-electrons, and a first pole piece and a second pole piece installed respectively at both sides of the anode cylinder, a first magnet and a second magnet placed in the yoke at both ends of the anode unit respectively to generate a magnetic field, and an output unit having an antenna lead connected to any one vane among the vanes to transmit high-frequency microwaves, generated via rotation of the group of electrons under the influence of the magnetic field and the electric field, to the outside of the yoke, wherein the first pole piece of the anode unit includes a first flat portion, a slope formed at an inner side of the first flat portion, a second flat portion formed at an inner side of the slope and having a diameter from approximately 9.5 mm to approximately 10.5 mm, a first hole formed in the second flat portion at a position corresponding to the working space and having a diameter from approximately 8 mm to approximately 8.2 mm, and a second hole formed in the slope for penetration of the antenna lead.

Each of the vanes may have a height from approximately 7.9 mm to approximately 8.1 mm, and a diameter of an inscribed circle defined by the radially arranged vanes may be from approximately 8.0 mm to approximately 8.2 mm.

The filament may have a coil form, and an outer diameter of the filament may be from approximately 3.6 mm to approximately 3.8 mm.

A distance between the antenna lead and an end of the vane to which the antenna lead is mounted may be from approximately 6.8 mm to approximately 7.2 mm.

The second pole piece of the anode unit may include a first flat portion, a slope formed at an inner side of the first flat portion, a second flat portion formed at an inner side of the slope and having a diameter from approximately 10.5 mm to approximately 11.5 mm, and a first hole formed in the center of the second flat portion at a position corresponding to the working space and having a diameter from approximately 8.4 mm to approximately 8.6 mm.

A distance between the second flat portion of the first pole piece and any one vane and a distance between the second flat portion of the second pole piece and the vane may be from approximately 1.3 mm to approximately 1.5 mm.

The cathode unit may further include a first end hat and a second end hat coupled respectively to both ends of the filament, an outer diameter of each of the first end hat and the second end hat may be approximately 7.2 mm, and a distance between the first end hat and the second end hat may be approximately 9.0 mm.

The magnetron may further include an input unit having an input terminal connected to the cathode unit to supply power to the cathode unit, and a filter unit having a filter box to cover the input unit, a condenser penetrating the filter box, and a plurality of filters in the form of choke coils arranged in the filter box and connected between the condenser and the input unit, and each of the choke coils may include a magnetic substance core having a diameter of approximately 4.0±0.2 mm and a length of approximately 15.0±0.5 mm, a first coil and a second coil wound around the magnetic substance core, a first connection portion connecting the first coil and the second coil to each other, a third coil connected to the second coil, a fourth coil located at one side of the third coil, and a second connection portion connecting the third coil and the fourth coil to each other.

The first coil and the second coil may be core type dense coils, the third coil may be an air core type dense coil, and the fourth coil may be an air core type sparse coil, and the first coil may have 4 turns, the first connection portion may have 1 turn, the second coil may have 3 turns, the third coil may have 2 turns, the second connection portion may have 1 turn, and the fourth coil may have 2.5 to 3 turns.

An inner diameter of the choke coil may be approximately 4.5±0.2 mm.

The output unit may further include a first noise remover surrounding the antenna lead, a second noise remover in the form of a choke for third harmonics, and a third noise remover in the form of a choke for fifth harmonics, and the first noise remover may be formed by plating an iron plate having a thickness from approximately 0.2 mm to approximately 0.3 mm with copper to a thickness of approximately 2 μm to approximately 4 μm.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 12 is a comparison table of oscillation efficiency, load stability, and cathode back bombardment between the related art and the magnetron having the filter unit of FIG. 11;

FIGS. 14 and 15 are respectively a table and a graph illustrating oscillation efficiency variation per a surface treated metal of the output unit included in the magnetron in accordance with the embodiment of FIG. 2.

DETAILED DESCRIPTION

Figure 1:
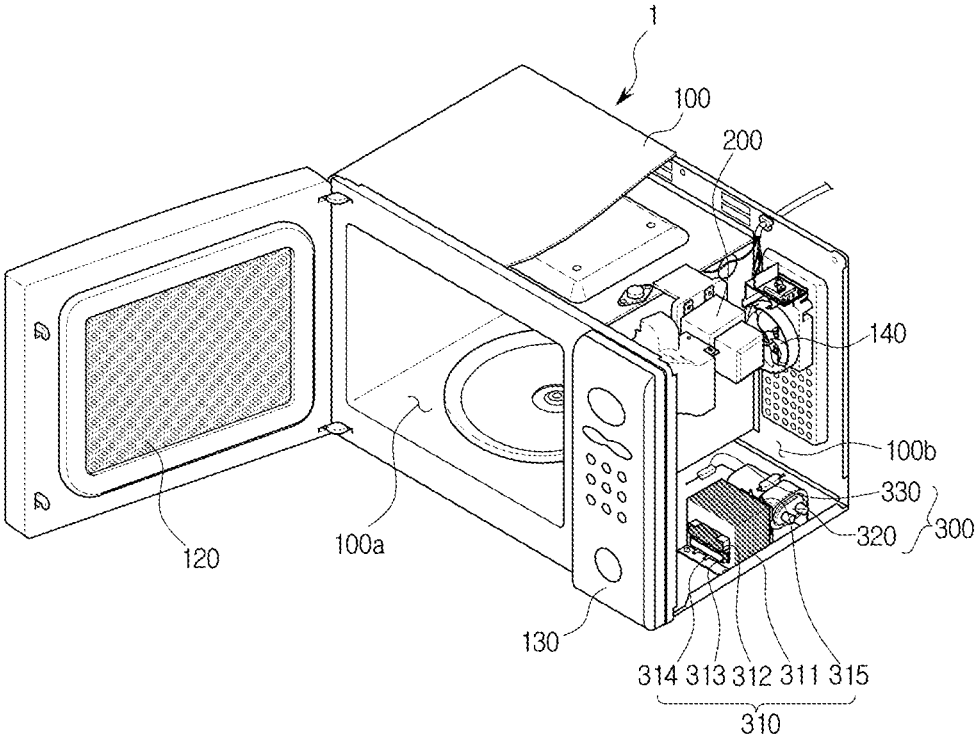
FIG. 1 is a view illustrating a high-frequency heating apparatus having a magnetron, i.e. a microwave oven in accordance with an embodiment.

Reference will now be made in detail to the embodiments, examples of which are illustrated in the accompanying drawings, wherein like reference numerals refer to the like elements throughout. The embodiments are described below to explain the present disclosure by referring to the figures.

FIG. 1 is a view illustrating a high-frequency heating apparatus having a magnetron, i.e. a microwave oven in accordance with an embodiment.

As exemplarily shown in FIG. 1, the microwave oven 1 includes a housing 100 defining an external appearance of the microwave oven 1.

The housing 100 is divided into two regions. One region is a cooking chamber 100*a*, the front face of which is open to enable introduction and removal of food. The other region is a hermetically sealed electric element chamber 100*b* in which electric elements for heating of food are mounted.

The cooking chamber 100*a* of the housing 100 is provided at the front face thereof with a door 120 to open or close the cooking chamber 100*a*. The electric element chamber 100*b* of the housing 100 is provided at the front face thereof with a control panel 130 for input and output of operating information for food cooking.

In addition, the microwave oven 1 may include a fan 140 mounted in the electric element chamber 100*b*. The fan 140 serves to cool the electric elements mounted in the electric element chamber 100*b* by suctioning in outside air.

The microwave oven 1 further includes a magnetron 200 mounted in the electric element chamber 100*b* to generate microwaves to be radiated into the cooking chamber 100*a*.

The magnetron 200 will be described below.

Other elements included in the microwave oven 1 include a high-voltage transformer 310, a high-voltage condenser 320, and a high-voltage diode 330, which are mounted in the electric element chamber 100*b* and constitute a drive module 300 to operate the magnetron 200.

The high-voltage transformer (HVT) 310 outputs high-voltage of approximately 2000 volts upon receiving commercial alternating current (AC) power of 110 volts or 220 volts. The output voltage is doubled by the high-voltage condenser 320 and the high-voltage diode 330 to be kept at approximately 4000 volts.

As the voltage is supplied to the magnetron 200, the magnetron 200 generates microwaves of 2450 MHz.

The high-voltage transformer 310 includes a core 311, a primary coil 312, and a secondary coil 313.

More specifically, the core 311 included in the high-voltage transformer 310 is constructed by laminating silicon steel plates, or permalloy or ferrite steel plates to one another, and the primary coil 312 and the secondary coil 313 are wound around the core 311.

The primary coil 312 is provided with an input terminal 314 to receive commercial power, and the secondary coil 313 is provided with an output terminal 315 to output high-voltage power.

The magnitude of output voltage from the output terminal 315 is determined by the turn-ratio of the primary coil 312 and the secondary coil 313.

Hereinafter, the magnetron 200 will be described in more detail with reference to FIGS. 2 and 3.

Figure 2:
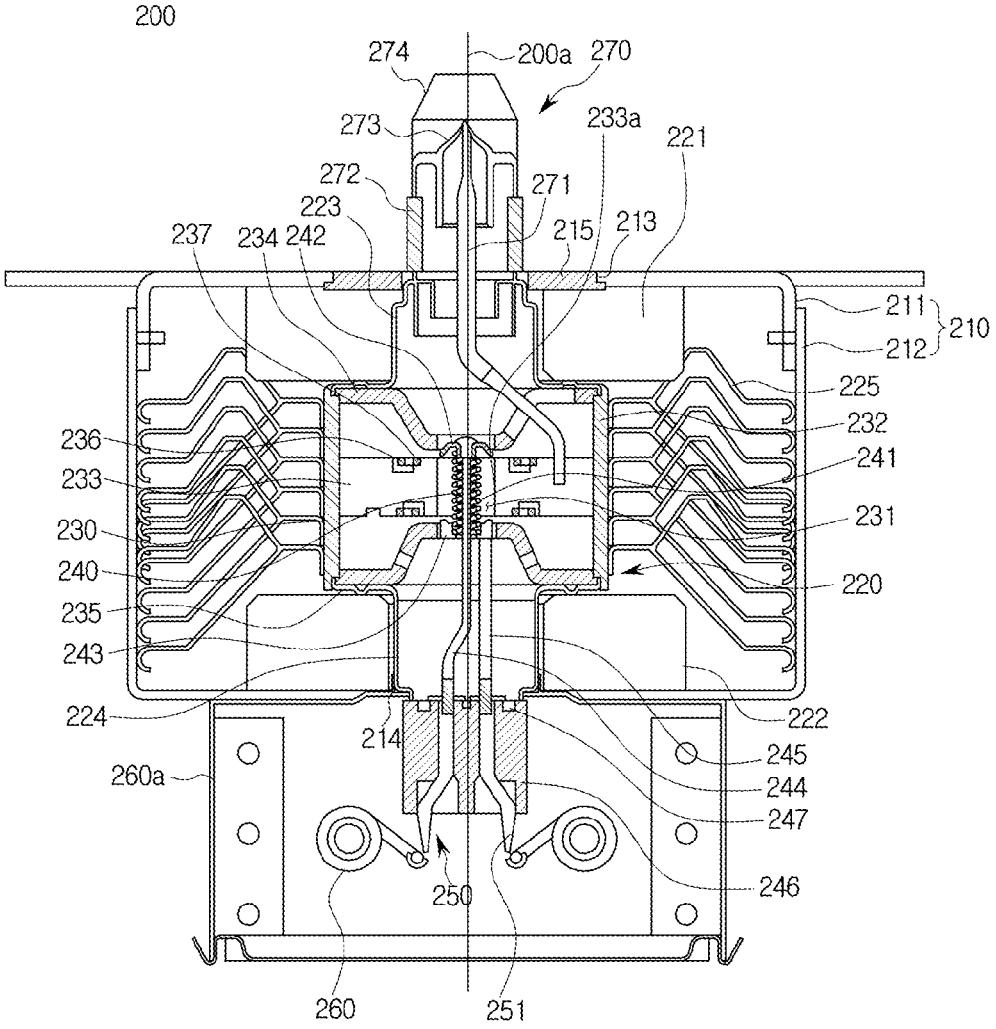
FIG. 2 is a detailed view illustrating a magnetron in accordance with an embodiment.

As exemplarily shown in FIG. 2, the magnetron 200 includes a yoke 210 having an inner receiving space, and a high-frequency generator 220 installed in the inner receiving space of the yoke 210 to generate high-frequency microwaves.

Here, the high-frequency generator 220 includes a first magnet 221 installed to a face of the yoke 210 having an opening 213 to be received in the inner receiving space of the yoke 210, a second magnet 222 installed to a face of the yoke 210 opposite to the opening 213, an anode unit 230 located between the first magnet 221 and the second magnet 222, and a cathode unit 240 located in the anode unit 230.

Here, the first magnet 221 is an output-side annular permanent magnet, and the second magnet 222 is an input-side annular permanent magnet.

The yoke 210, more particularly, a first yoke 211 and a second yoke 212, the first magnet 221, and the second magnet 222 are arranged to surround the anode unit 230 and the cathode unit 240 and to constitute a magnetic circuit.

The magnetron 200 further includes an input unit 250 to apply power to the high-frequency generator 220, a filter unit 260 connected to the input unit 250, and an output unit 270 to radiate high-frequency microwaves, generated by the high-frequency generator 220, to the outside of the yoke 210.

More specifically, the yoke 210 includes the first yoke 211 and the second yoke 212 coupled to the first yoke 211. The first yoke 211 has a center opening 213 for passage of the output unit 270, and the second yoke 212 has a center connection port 214 for connection of the input unit 250.

The yoke 210 further includes an electromagnetic-wave leak-proof gasket 215 fitted into the opening 213 of the yoke 210 to prevent outward leakage of electromagnetic waves generated in the yoke 210.

The first yoke 211 may have a coupling protrusion (not shown) to be coupled to a coupling groove of a waveguide tube (not shown) of a high-frequency device. As the coupling protrusion is inserted into the coupling groove of the waveguide tube, the magnetron 200 may be coupled to the waveguide tube.

Upon coupling of the magnetron 200, the output unit 270 is inserted into a guide groove (not shown) of the waveguide tube to enable radiation of high-frequency microwaves into the waveguide tube.

The high-frequency generator 220 further includes a first sealing member 223 and a second sealing member 224 arranged respectively inside the first magnet 221 and the second magnet 222 to fix the anode unit 230 and to hermetically seal the interior of the anode unit 230 to prevent oxidation of inner elements.

The first sealing member 223 and the second sealing member 224 respectively penetrate the first magnet 221 and the second magnet 222 to protrude to the opening 213 and the connection port 214 of the yoke 210.

The first sealing member 223 and the second sealing member 224 include outwardly expanded flange portions respectively, and the respective flange portions are welded to the top and bottom of the anode unit 230.

The high-frequency generator 220 further includes a plurality of cooling fins 225 arranged around the anode unit 230 in the receiving space to cool the anode unit 230.

The anode unit 230 includes an anode cylinder 232 surrounded by the cooling fins 225 and centrally defining a working space 231, a plurality of vanes 233 radially arranged about a center axis 200*a* of the working space 231, and a first pole piece 234 and a second pole piece 235 respectively installed to the top and bottom of the anode cylinder 232 to allow a magnetic field, generated by the first magnet 221 and the second magnet 222, to be concentrated on the working space 231.

More specifically, the first sealing member 223 and the second sealing member 224 are installed to the top and bottom of the anode cylinder 232 to prevent oxidation of elements by hermetically sealing the interior of the anode cylinder 232.

Approximately ten vanes 233 are included in the anode unit 230.

Each vane 233 takes the form of a rectangular plate, an outer end of which is fixed to an inner surface of the anode cylinder 232 and an inner end of which is fixed to first and second strap rings 236 and 237. Here, the first strap ring 236 is larger than the second strap ring 237, and the first and second strap rings 236 and 237 form a pair.

Upon fixing plural vanes using pairs of strap rings, two vanes are fixed using a pair of strap rings, a following vane is not fixed, and the following two vanes are fixed using a pair of strap rings.

A pair of pole pieces 234 and 235 takes the form of a funnel having a center hole respectively.

Tip ends 233*a* of the vanes 233 not fixed to the inner surface of the anode cylinder 232 are located at the same inscribed circle extending along the axis 200*a*.

Figure 3:
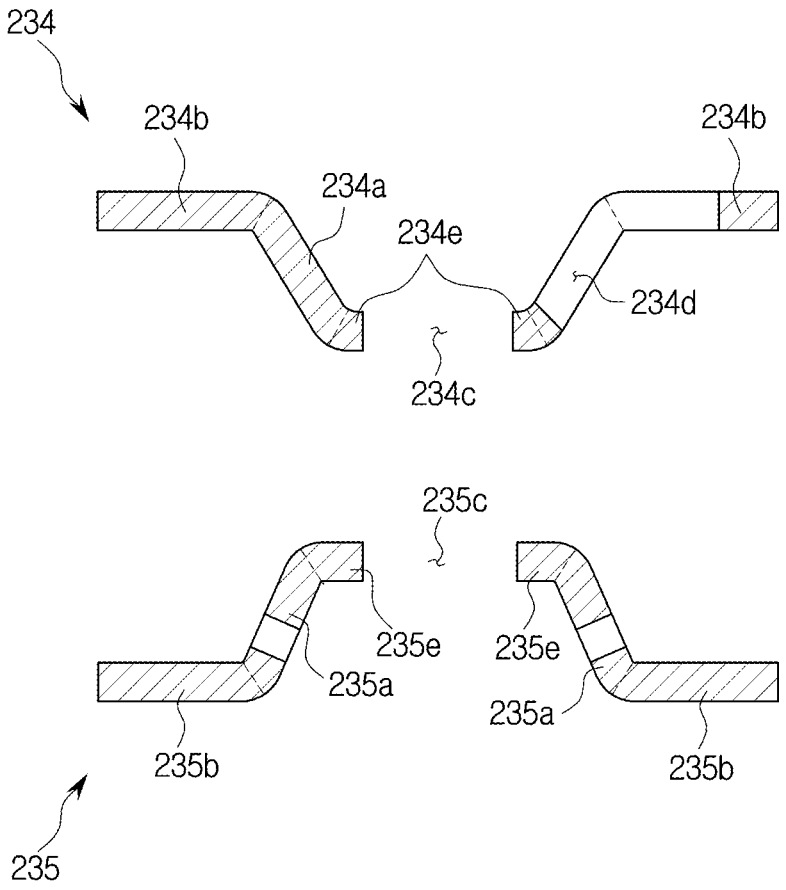
FIG. 3 is a detailed view illustrating first and second pole pieces included in the magnetron in accordance with the embodiment of FIG. 2.

As exemplarily shown in FIG. 3, the first pole piece 234 includes a slope 234*a*, a first flat portion 234*b* formed at the outer periphery of the slope 234*a* and extending parallel to the vanes 233, a second flat portion 234*e* formed at the inner periphery of the slope 234*a* and extending parallel to the vanes 233, a first hole 234*c* perforated in the center of the second flat portion 234*e*, and a second hole 234*d* perforated at the boundary of the slope 234*a* and the first flat portion 234*b* for penetration of an antenna lead 271.

The second pole piece 235 has a configuration similar to that of the first pole piece 234.

The second pole piece 235 includes a centrally positioned slope 235*a*, a first flat portion 235*b* formed at the outer periphery of the slope 235*a* and extending parallel to the vanes 233, a center first hole 235*c*, and a second flat portion 235*e* located between the slope 235*a* and the center first hole 235*c* and extending parallel to the vanes 233.

Centers of the first and second pole pieces 234 and 235 are located on the axis 200*a*.

The cathode unit 240 includes a coil-shaped filament 241 spaced apart from the respective vanes 233 and positioned at the center of an inscribed circle of the vanes 233, i.e. at the center of the working space 231, a first end hat 242 and a second end hat 243 coupled respectively to an upper end and a lower end of the filament 241, a center lead 244 installed in the center of the filament 241 and having an upper end coupled to the first end hat 242 and a lower end penetrating the second end hat 243 to extend downward, and a side lead 245 coupled to a peripheral portion of the second end hat 243.

The first end hat 242 and the second end hat 243, to which both ends of the filament 241 are installed respectively, have an outer diameter to restrict escape of electrons from the working space 231. To this end, the outer diameter is set to approximately 90% of an inscribed circle of the vanes 233.

The center lead 244 and the side lead 245 are connected to an external power source to apply power to the filament 241. Lower portions of the center lead 244 and the side lead 245 are surrounded and fixed by a first insulator 246.

When power is applied to the center lead 244 and the side lead 245, the filament 241 discharges thermo-electrons toward the vanes 233.

A pair of the center lead 244 and the side lead 245, for example, penetrates a pair of relay plates 247 to protrude outward of the yoke 210, thereby being connected to a pair of input terminals 251.

The input unit 250 includes the input terminals 251 connected respectively to the center lead 244 and the side lead 245.

The input unit 250 further includes a plug (not shown) connected to both the input terminals 251 for power supply.

The filter unit 260 includes a plurality of filters 261, 262 connected to the input unit 250. Here, the filters 261 and 262 are choke coils.

The filter unit 260 includes a filter box 260*a* coupled to the second yoke 212 to cover the connection port 214, to prevent electromagnetic waves generated in the anode cylinder 232 from leaking outward through the connection port 214.

A high-voltage condenser 260*b* penetrates the filter box 260*a*.

The filter unit 260 will be described below in detail.

The output unit 270 is located above the first pole piece 234 in an axial direction to radiate microwaves. To radiate high-frequency microwaves outward of the yoke 210, the output unit 270 includes the antenna lead 271, one end of which is connected to any one vane 233 and the other end of which extends outward through the opening 213.

The output unit 270 further includes a second insulator 272 bonded to the first sealing member 223 and configured to allow penetration of the antenna lead 271 therein, a vent tube 273 coupled to the second insulator 272 and configured to allow penetration of the antenna lead 271 therein, and an antenna cap 274 to cover the vent tube 273.

That is, the antenna lead 271, having passed through the second hole 234*d* of the first pole piece 234, extends into the output unit 270 such that a tip end thereof is tightly fixed in the vent tube 273. The entire vent tube 273 is covered with the antenna cap 274.

The second insulator 272 is bonded to the first sealing member 223 at an opposite side of the first pole piece 234 connected to the first sealing member 223.

The second insulator 272 is coupled at one side thereof to the opening 213 of the yoke 210 and an opposite side of the second insulator 272 is bonded to the vent tube 273.

Operation of the above described microwave oven 1 will be described below.

When food is put into the cooking chamber 100*a* and the microwave oven 1 is operated via the control panel 130, commercial power is applied to the high-voltage transformer 310, and the high-voltage transformer 310 boosts the commercial power to approximately 2000 volts.

The voltage is again doubled to approximately 4000 volts by the high-voltage condenser 320 and the high-voltage diode 330 and then transmitted to the magnetron 200.

The magnetron 200 discharges thermo-electrons from the filament 241 as the filament 241 is heated upon receiving power through the center lead 244 and the side lead 245 of the cathode unit 240.

The discharged thermo-electrons define a group of electrons in the working space 231 between the filament 241 and the vanes 233.

In addition, a strong electric field is created in the working space 231 by drive voltage applied to the anode unit 230, and a magnetic field created between the first magnet 221 and the second magnet 222 is vertically applied through the first pole piece 234 and the second pole piece 235.

Thereby, the group of electrons, discharged from the filament 241 into the working space 231, moves to the vanes 233 via spiral rotation thereof under the influence of the strong electric field and the magnetic field, and high-frequency microwaves having a resonance frequency corresponding to the rotation speed of the group of electrons are directed to the vanes 233.

The high-frequency microwaves, directed to the vanes 233, are transmitted outward of the yoke 210 via the antenna lead 271, and are guided from the antenna cap 274 to a waveguide tube.

That is, when high-voltage power is applied to the magnetron 200, the high-frequency generator 220 generates microwaves of 2450 MHz to radiate the same into the cooking chamber 100*a*, which allows food in the cooking chamber 100*a* to be cooked by the microwaves.

Meanwhile, in operation of the microwave oven 1, the fan 140 is operated to circulate outside air into the electric element chamber 100*b* for cooling of the magnetron 200 or the high-voltage transformer 310.

Figure 4:
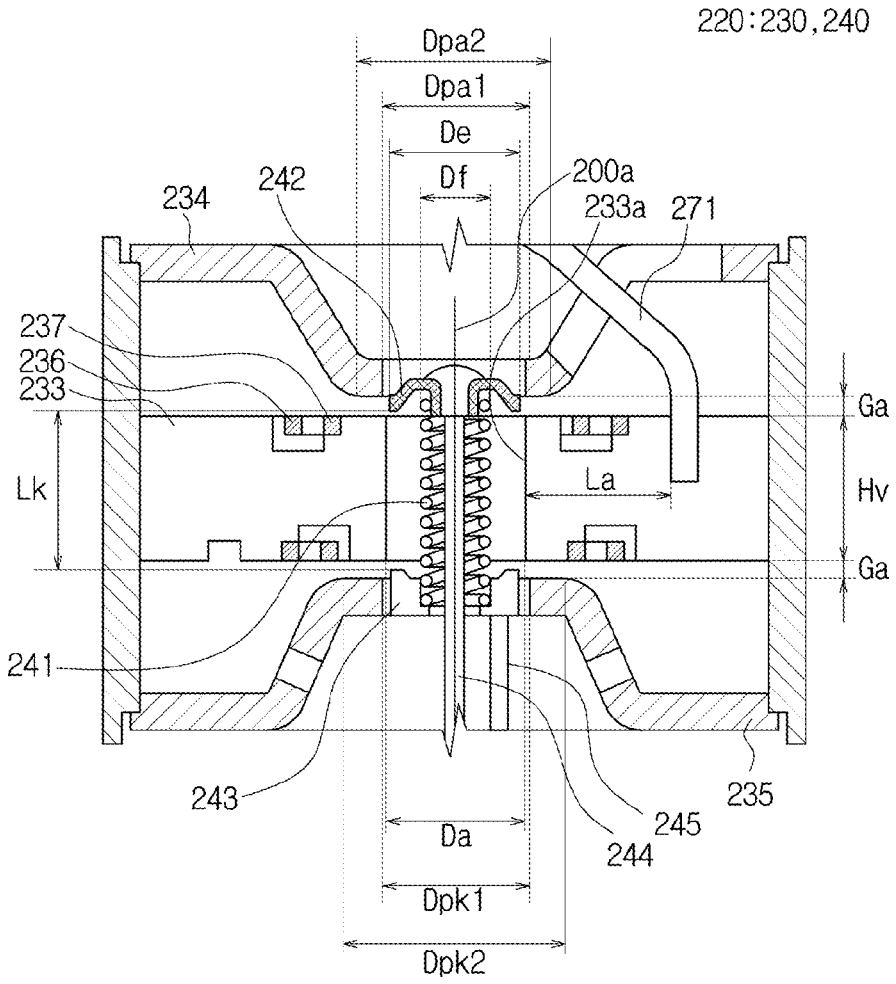
FIG. 4 is a detailed view illustrating a high-frequency generator included in the magnetron in accordance with the embodiment of FIG. 2.

Now, a configuration of the magnetron will be described in more detail with reference to FIG. 4.

More particularly, arrangement of the anode unit 230 and the cathode unit 240 included in the high-frequency generator 220 will be described below in detail.

An axial height Hv of each vane 233 is from approximately 7.9 mm to approximately 8.1 mm, and a diameter Da of an inscribed circle of the vane 233 is from approximately 8.0 mm to approximately 8.2 mm.

An outer diameter De of the end hats 242 and 243 is approximately 7.2 mm.

A diameter Dpa1 of the first hole of the first pole piece 234 is from approximately 8.0 mm to approximately 8.2 mm, and a diameter Dpa2 of the second flat portion 234*e* of the first pole piece 234 is from approximately 9.5 mm to approximately 10.5 mm.

In addition, a diameter Dpk1 of the first hole of the second pole piece 235 is from approximately 8.4 mm to approximately 8.6 mm, and a diameter Dpk2 of the second flat portion 235*e* of the second pole piece 235 is from approximately 10.5 mm to approximately 11.5 mm.

A gap Ga between the bottom of each pole piece 234 or 235 and the vane 233 is from approximately 1.3 mm to approximately 1.5 mm.

An outer diameter Df of the filament 241 is from approximately 3.6 mm to approximately 3.8 mm.

A distance Lk between the end hats 242 and 243, corresponding to the axial height Hv of the vane 233, is approximately 9.0 mm.

An installation position La of the antenna lead 271, fixed to one vane 233, is spaced apart from the tip end 233*a* of the vane 233 by a distance from approximately 6.8 mm to approximately 7.2 mm. In the following description, the installation position La is represented by the distance.

Next, arrangement of inner elements of the magnetron and operational effects depending on the arrangement will be described with reference to FIGS. 5 to 16.

Figure 5:
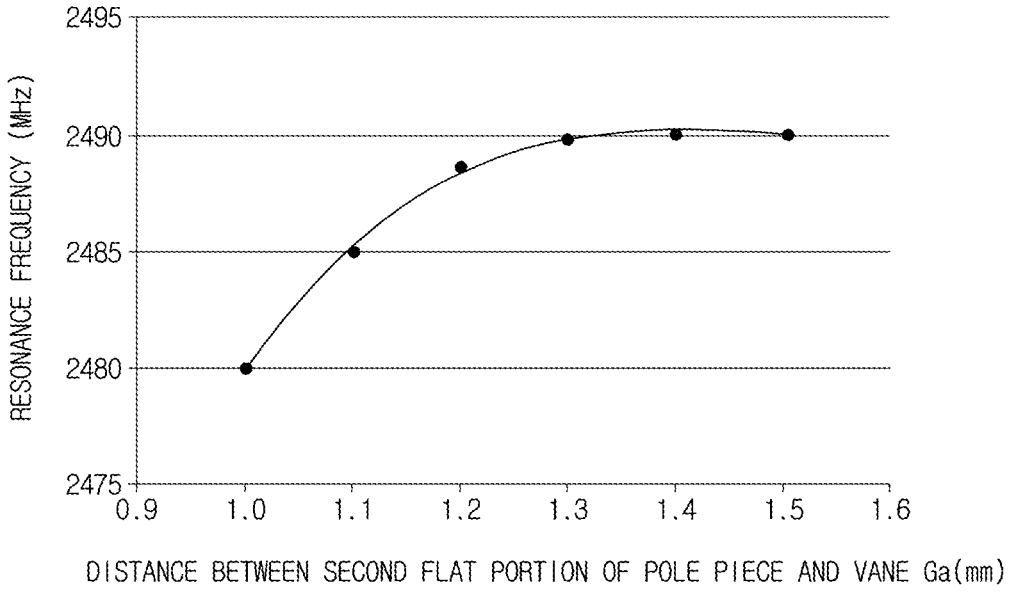
FIG. 5 is a graph illustrating a resonance frequency depending on a distance Ga between the bottom of each pole piece and a vane included in the magnetron in accordance with the embodiment of FIG. 2.

FIG. 5 is a graph illustrating a resonance frequency depending on a distance Ga between the bottom of each pole piece 234 or 235 and the vane 233.

A distance between the second flat portion of the pole piece 234 or 235 and the vane 233 may be advantageously small to apply a magnetic force to the working space 231 between the tip end 233*a* of the vane 233 and the filament 241. However, this small distance may cause microwave coupling due to increased capacitance between the second flat portion of the pole piece 234 or 235 and the vane 233, resulting in resonance frequency variation or microwave power loss due to deterioration of resonance sharpness (Q) of a cavity resonator, or the like.

Accordingly, it may be necessary to determine a distance between the second flat portion of the pole piece 234 or 235 and the vane 233 after checking resonance frequency variation of the cavity resonator depending on the distance between the second flat portion of the pole piece 234 or 235 and the vane 233.

As exemplarily shown in FIG. 5, resonance variation begins to decrease from a point where a distance Ga between the second flat portion of the pole piece 234 or 235 and the vane 233 is approximately 1.30 mm.

In addition, it will be appreciated that the most suitable distance Ga between the second flat portion of the pole piece 234 or 235 and the vane 233 is approximately 1.35 mm because this is the shortest distance to achieve the highest resonance frequency.

Figure 6:
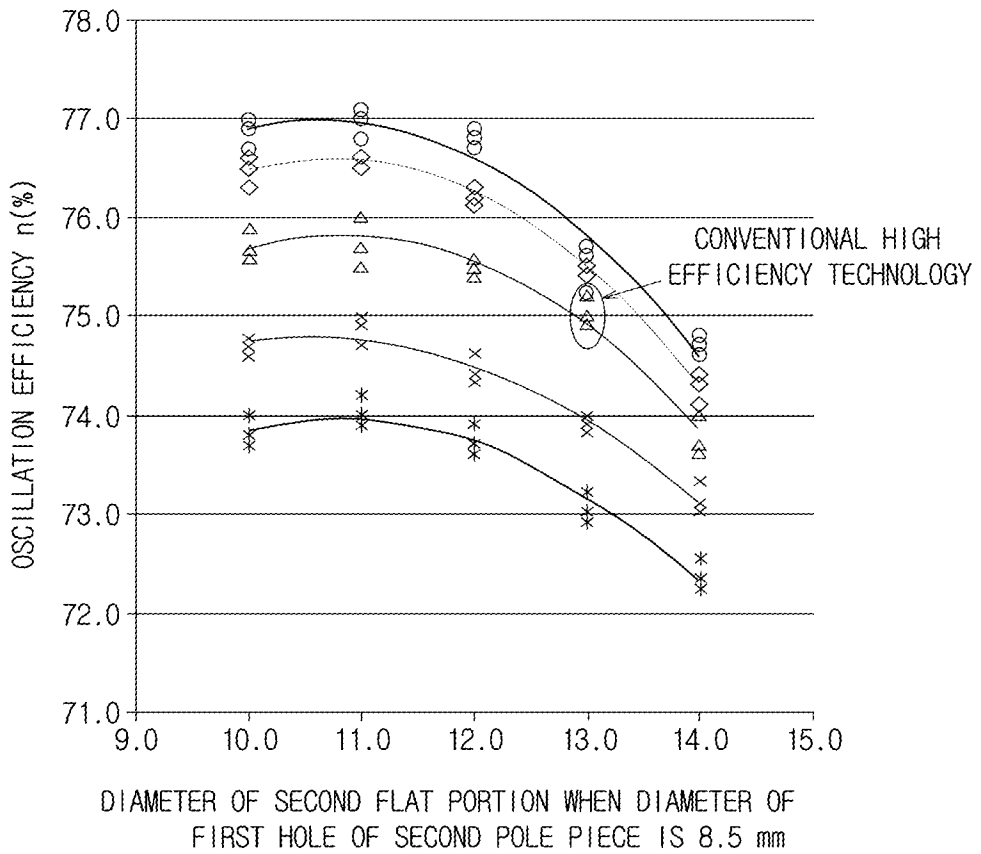
FIG. 6 is a graph illustrating oscillation efficiency ηper diameter of a second flat portion of each pole piece included in the magnetron in accordance with the embodiment of FIG. 2.
Figure 7:
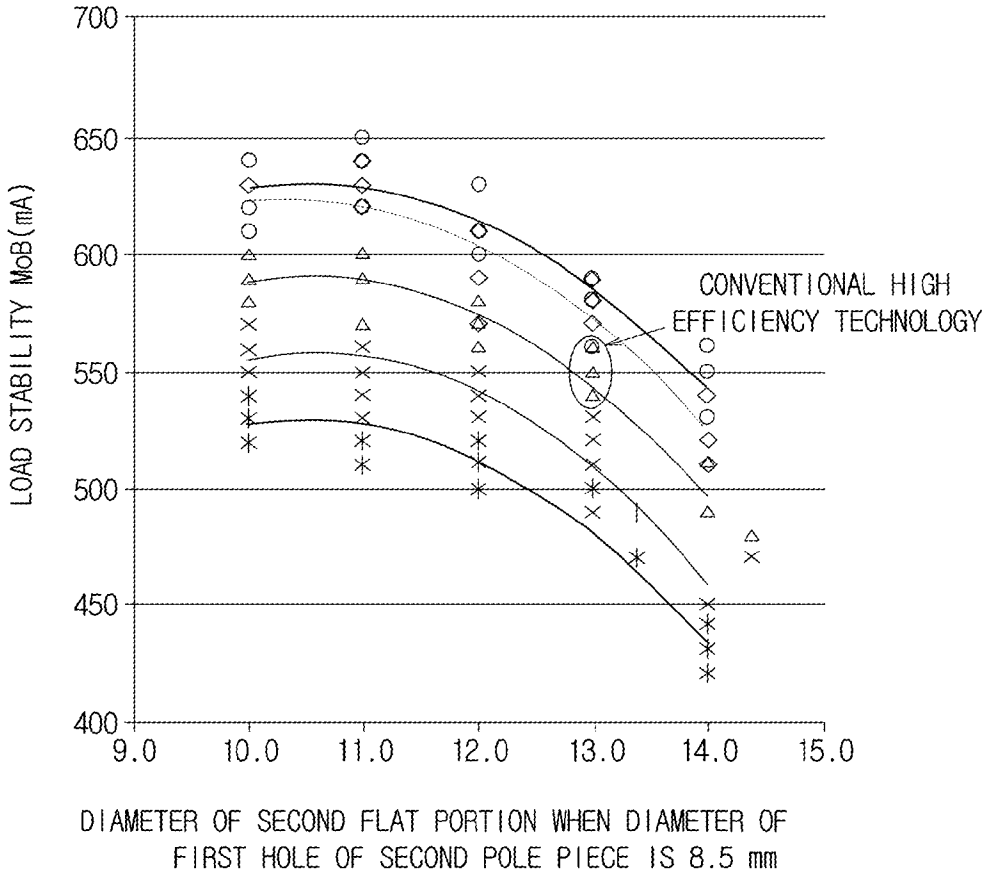
FIG. 7 is a graph illustrating load stability (MoB) per diameter of the second flat portion of each pole piece included in the magnetron in accordance with the embodiment of FIG. 2.

FIG. 6 is a graph illustrating oscillation efficiency ηper diameter of the second flat portion of the pole piece 234 or 235, and FIG. 7 is a graph illustrating load stability (MoB) per diameter of the second flat portion of the pole piece 234 or 235. The oscillation efficiency η and load stability (MoB) may be used to set a diameter of the second flat portion of the pole piece 234 or 235 suitable to improve distribution of electrons in the working space 231 and to achieve high efficiency.

FIGS. 6 and 7 show measured results of oscillation efficiency η under matched load that causes no reflection (VSWR=1.0) and load stability (MoB) as an index of oscillation stability under mismatched load that causes power reflection (VSWR≤4), when varying a diameter Dpk2 of the second flat portion of the second pole piece and a diameter Dpa2 of the second flat portion of the first pole piece, in a state in which a position La of the antenna lead 271 mounted to the vane 233 is set to approximately 8.5 mm, a diameter Da of an inscribed circle of the vane 233 is set to approximately 8.1 mm, an outer diameter Df of the filament 241 is set to approximately 3.7 mm, a distance Ga between the second flat portion of the pole piece 234 or 235 and the vane 233 is set to approximately 1.35 mm, a diameter Dpk1 of the first hole of the second pole piece is set to approximately 8.5 mm, and a diameter Dpa1 of the first hole of the first pole piece is set to approximately 8.1 mm, in the same manner as in a conventional magnetron.

As exemplarily shown in FIGS. 6 and 7, it will be appreciated that the diameter Dpa2 of the second flat portion of the first pole piece 234 is approximately 10.0 mm when the diameter Dpa1 of the first hole is approximately 8.1 mm, the diameter Dpk2 of the second flat portion of the second pole piece 235 is approximately 11.0 mm when the diameter Dpk2 of the first hole is approximately 8.5 mm, oscillation efficiency η under matched load that causes no reflection (VSWR=1.0) is increased by approximately 2%, and load stability (MoB) under mismatched load that causes power reflection (VSWR≤4) is increased by approximately 15%.

Figure 8:
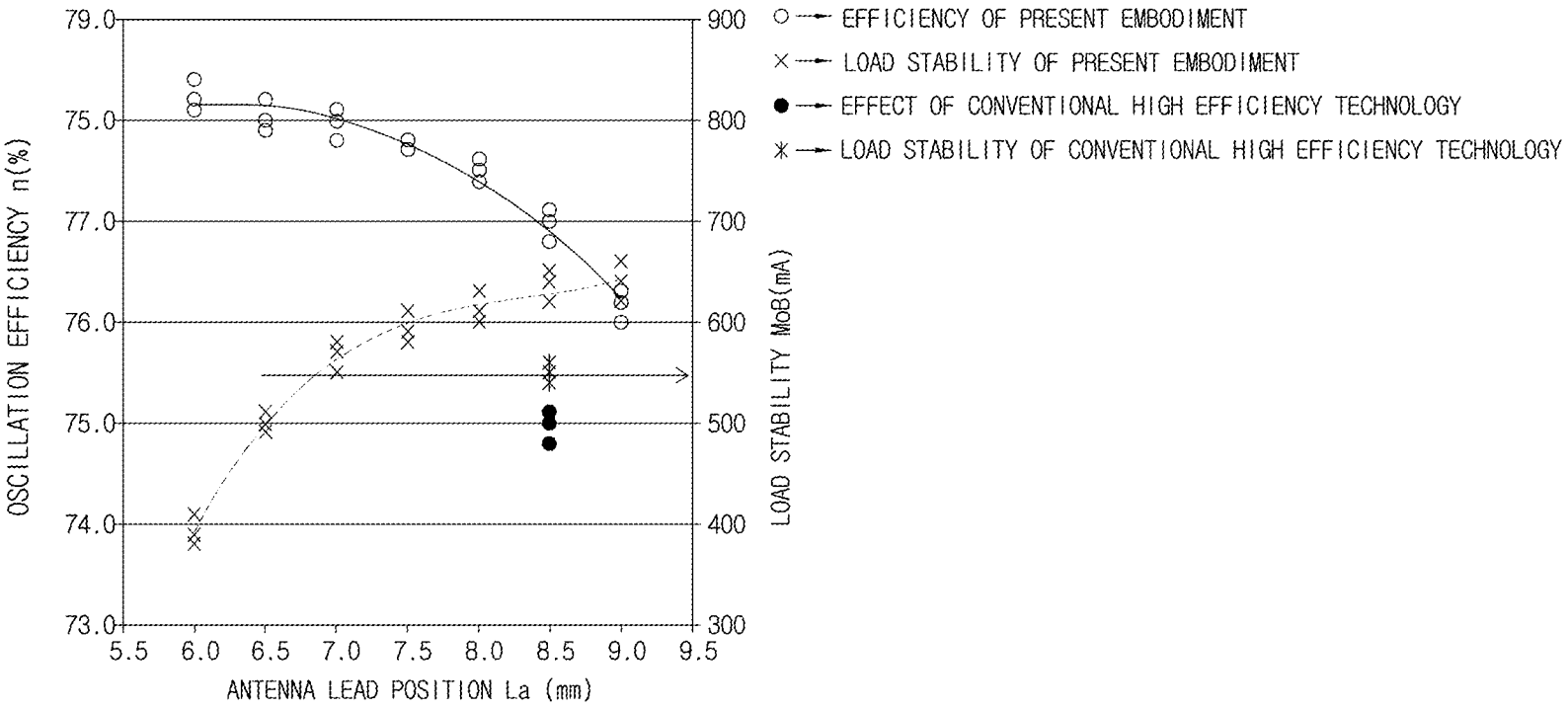
FIG. 8 is a graph illustrating oscillation efficiency and load stability per position of an antenna lead mounted to a vane included in the magnetron in accordance with the embodiment of FIG. 2.

FIG. 8 is a graph illustrating oscillation efficiency and load stability per position of the antenna lead.

FIG. 8 shows measured results of oscillation efficiency η under adjusted load that causes no reflection (VSWR=1.0) and load stability (MoB) under mismatched load that causes power reflection (VSWR≤4), when varying a position La of the antenna lead 271 that determines a microwave coupling degree by separating microwave power from a cavity resonator, in a state in which a diameter Dpa1 of the first hole of the first pole piece is approximately 8.1 mm, a diameter Dpa2 of the second flat portion of the first pole piece is approximately 10.0 mm, a diameter Dpk1 of the first hole of the second pole piece is approximately 8.5 mm, and a diameter Dpk2 of the second flat portion of the second pole piece is approximately 11.0 mm.

As exemplarily shown in FIG. 8, it will be appreciated that the optimum position La of the antenna lead 271 mounted to the vane 233 is approximately 7.0 mm.

In addition, it will be appreciated that load stability (MoB) under mismatched load that causes power reflection (VSWR≤4) improves oscillation efficiency η under adjusted load that causes no reflection (VSWR=1.0) by approximately 1% under a conventional condition in which a position La of the antenna lead 271 is approximately 8.5 mm.

That is, higher efficiency may be achieved when a position La of the antenna lead 271 is approximately 7.0 mm than when a position La of the antenna lead 271 is approximately 8.5 mm.

Figure 9:
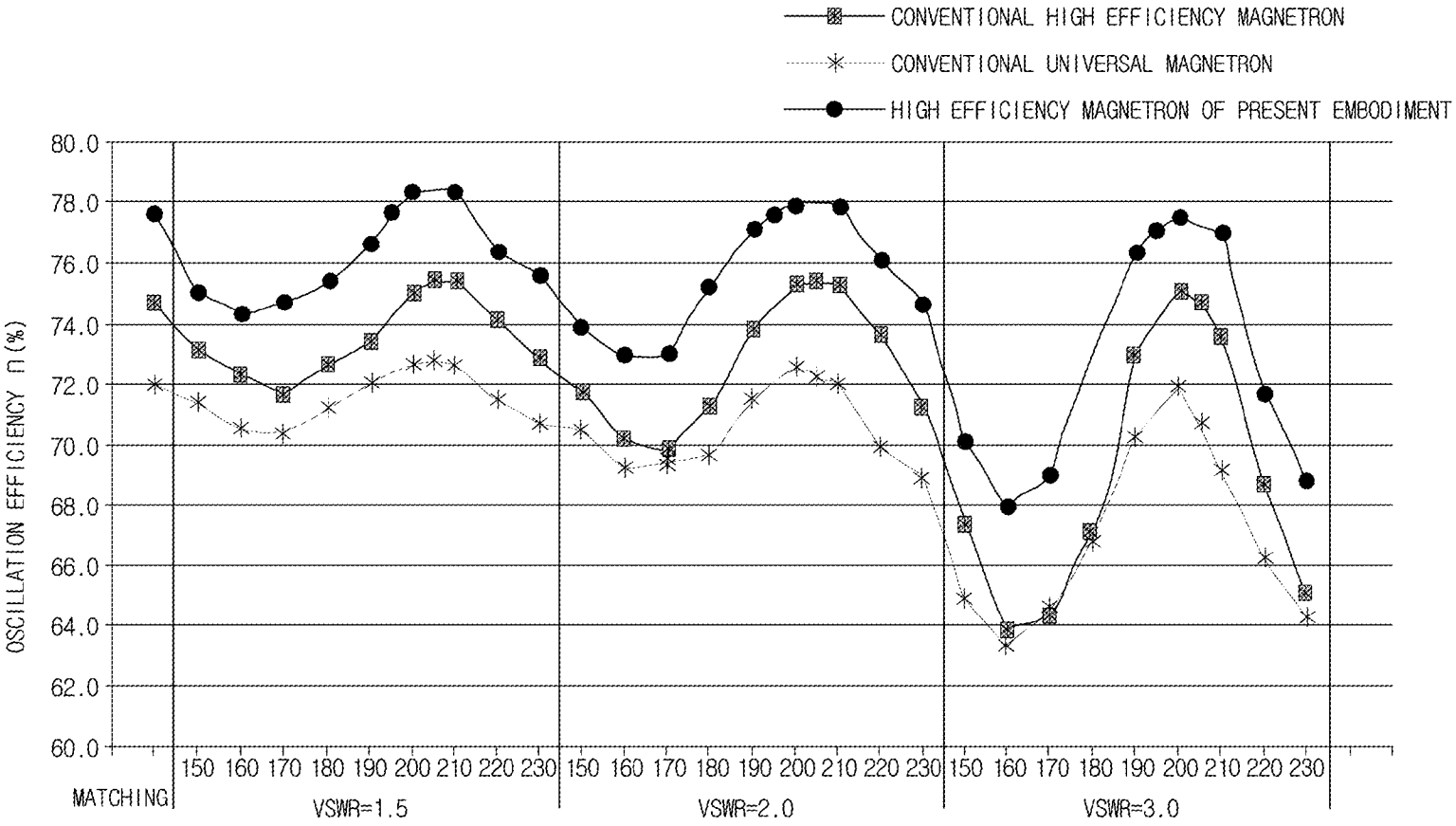
FIG. 9 is a graph illustrating variation of oscillation efficiency η of the magnetron in accordance with the embodiment of FIG. 2 and a conventional magnetron with respect to load variation (Voltage Standing Wave Ratio (VSWR)=1.5~3.0).

FIG. 9 is a graph illustrating variation of oscillation efficiency η of the magnetron in accordance with the embodiment and a conventional magnetron with respect to load variation (VSWR=1.5~3.0).

A standard copper waveguide tube tester was used to measure variation of oscillation efficiency η of the magnetron in accordance with the embodiment and the conventional magnetron with respect to load variation (VSWR=1.5~3.0).

Here, the standard copper waveguide tube tester (not shown) includes a magnetron coupler, a double slag tuner/variable impedance generator, a directional coupler, a frequency coupler, and an anti-reflection terminal. A load average in microwave power application apparatuses, such as a microwave oven, etc., may be reproduced by adjusting the double slag tuner/variable impedance generator.

The abscissa of the graph represents a load position in terms of a phase as a load average index and a VSWR as an index under occurrence of power reflection. The VSWR was 1.5, 2.0, and 3.0 to be substantially equivalent to a common load average of a microwave oven, etc., and for phase shift, the load position was moved to 80 mm by a pitch of 10 mm, to achieve half or more the wavelength of standing waves.

As exemplarily shown in FIG. 9, it will be appreciated that, in all load varied regions, oscillation efficiency of the magnetron in accordance with the embodiment is improved by approximately 3% as compared to that of a conventional high efficiency technology magnetron and by approximately 6% as compared to a conventional universal magnetron.

This is because optimizing a position of the antenna lead 271 at the vane 233 causes an increased separation/coupling degree of microwave power generated in a cavity resonator and higher efficiency, and changing diameters of the second flat portion and the first hole of each pole piece improves distribution of a distorted static field in an axial peripheral region of the working space 231, and consequently improves electron efficiency $\eta e$ in the axial peripheral region.

The present embodiment may improve oscillation efficiency and restrict oscillation efficiency variation caused by load variation, thus achieving significantly high efficiency suitable for energy saving.

Figure 10:
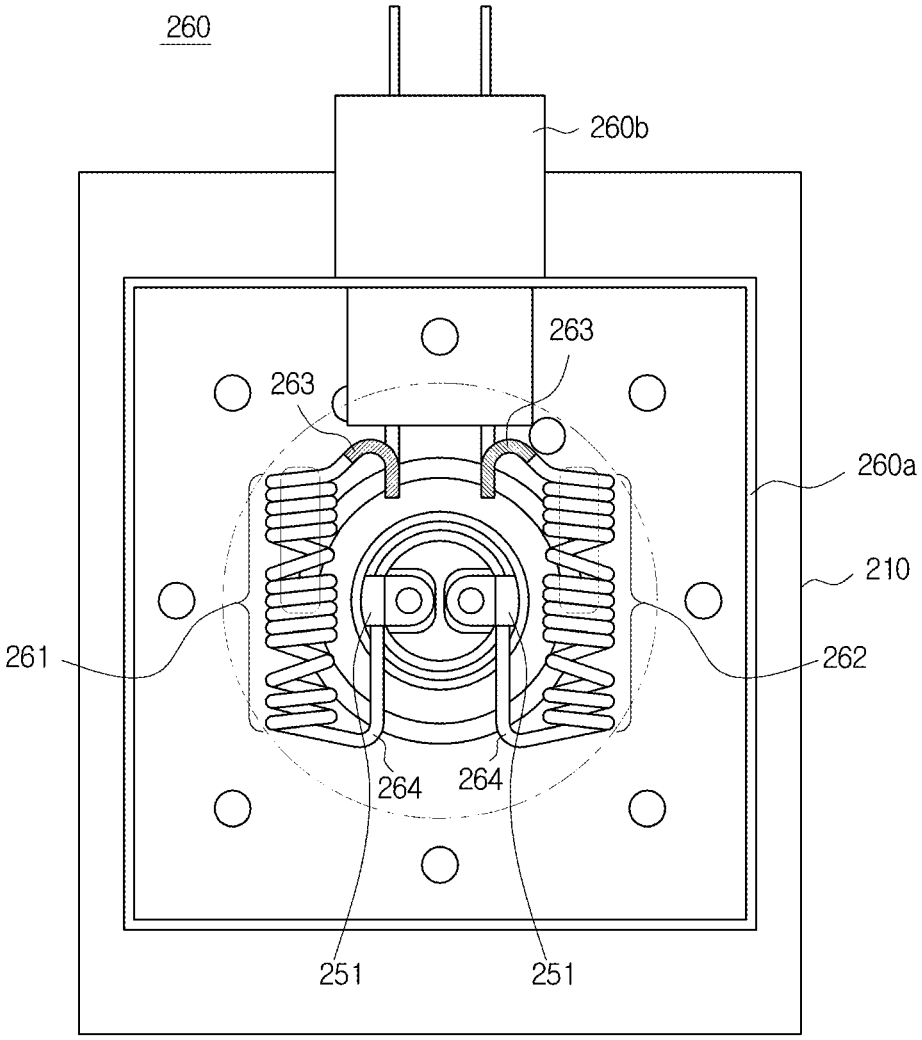
FIG. 10 is a detailed view illustrating a filter unit included in the magnetron in accordance with the embodiment of FIG. 2.
Figure 11:
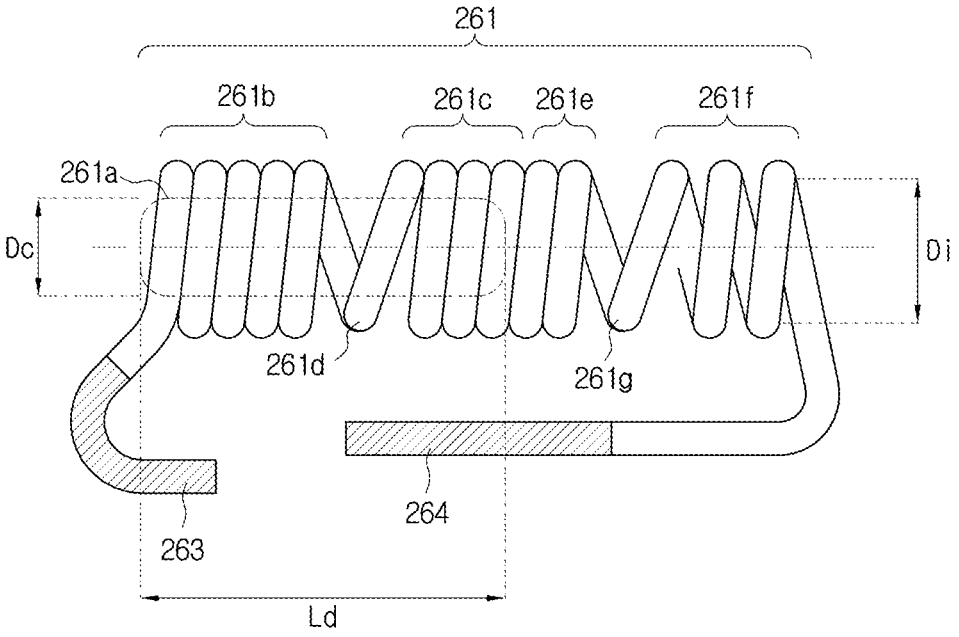
FIG. 11 is a detailed view illustrating a choke coil of the filter unit included in the magnetron in accordance with the embodiment of FIG. 2.

FIG. 10 is a detailed view illustrating the filter unit 260 included in the magnetron in accordance with the embodiment of FIG. 2, and FIG. 11 is a detailed view illustrating a choke coil of the filter unit 260 included in the magnetron in accordance with the embodiment of FIG. 2.

The filter unit 260 includes the condenser 260*b* penetrating one sidewall of the filter box 260*a* and having two terminals.

The filter unit 260 further includes first and second choke coils 261 and 262 received in the filter box 260*a* and connected in series between the input terminals 251 as cathode terminals on the filter box 260*a* and the terminals of the condenser 260*b* inside the filter box 260*a*.

Here, the condenser 260*b* and the choke coils 261 and 262 form an LC low-pass filter circuit.

The first and second choke coils 261 and 262 are connected respectively to the condenser 260*b* and the input terminals 251 via first connectors 263 and second connectors 264.

The first and second choke coils 261 and 262 have the same configuration, and thus the first choke coil 261 will be described below by way of example.

The first choke coil 261 includes a magnetic substance core 261*a*, a first coil 261*b*, and a second coil 261*c* connected to the first connector 263 and wound around the magnetic substance core 261*a*, a first connection portion 261*d* located between the first coil 261*b* and the second coil 261*c* to connect the first coil 261*b* and the second coil 261*c* to each other, a third coil 261*e* connected to the second coil 261*c*, a fourth coil 261*f* connected to the second connector 264 and located at one side of the third coil 261*e*, and a second connection portion 261*g* located between the third coil 261*e* and the fourth coil 261*f* to connect the third coil 261*e* and the fourth coil 261*f* to each other.

The first coil 261*b*, the second coil 262*c*, the third coil 261*e*, and the fourth coil 261*f* are connected to one another in series, and have a diameter of approximately 1.4 mm respectively.

Here, the first coil 261*b* and the second coil 261*c* are core type dense coils, the third coil 261*e* is an air core type dense coil, and the fourth coil 261*f* is an air core type sparse coil. That is, a core type coil having a magnetic substance core and an air core type inductor are connected to each other in series.

An inner diameter Di of the choke coil 261 is approximately 4.5±0.2 mm, and the choke coil 261 has an inductance from approximately 0.7 μH to approximately 0.9 μH. In addition, a diameter Dc of the magnetic substance core 261*a* inserted into the core type dense coils is approximately 4.0±0.2 mm, and a length Ld of the magnetic substance core 261*a* is approximately 15.0±0.5 mm.

The first coil 261*b* close to the condenser 260*b* has 4 turns, the first connection portion 261*d* has 1 turn, the second coil 261*c* has 3 turns, the third coil 261*e* has 2 turns, the second connection portion 261*g* has 1 turn, and the fourth coils 261*f* has 2.5~3 turns.

Most of microwaves generated in the yoke 210 of the magnetron 200 are emitted into the cooking chamber 100*a* via the output unit 270, thus serving as a microwave heat source, whereas some of the generated microwaves leak into the input unit 250 through the cathode unit 240 to thereby be absorbed and consumed by the choke coils 261 and 262 and the condenser 260*b* of the filter unit 260.

That is, the choke coils 261 and 262 and the condenser 260*b* may absorb and consume leaked microwaves reflected by the input unit 250 to thereby be returned to the cathode unit 240.

FIG. 12 is a comparison table of oscillation efficiency, load stability, and cathode back bombardment between the related art and the magnetron having the filter unit of FIG. 11.

As exemplarily shown in FIG. 12, it will be appreciated that changing the size of the magnetic substance core of the filter unit may optimize a configuration of the choke coil. That is, it will be appreciated that stabilized characteristics may be attained without causing oscillation efficiency variation, deterioration of load stability (MoB), and negative effects in terms of basic characteristics and noise of the magnetron.

Figure 13:
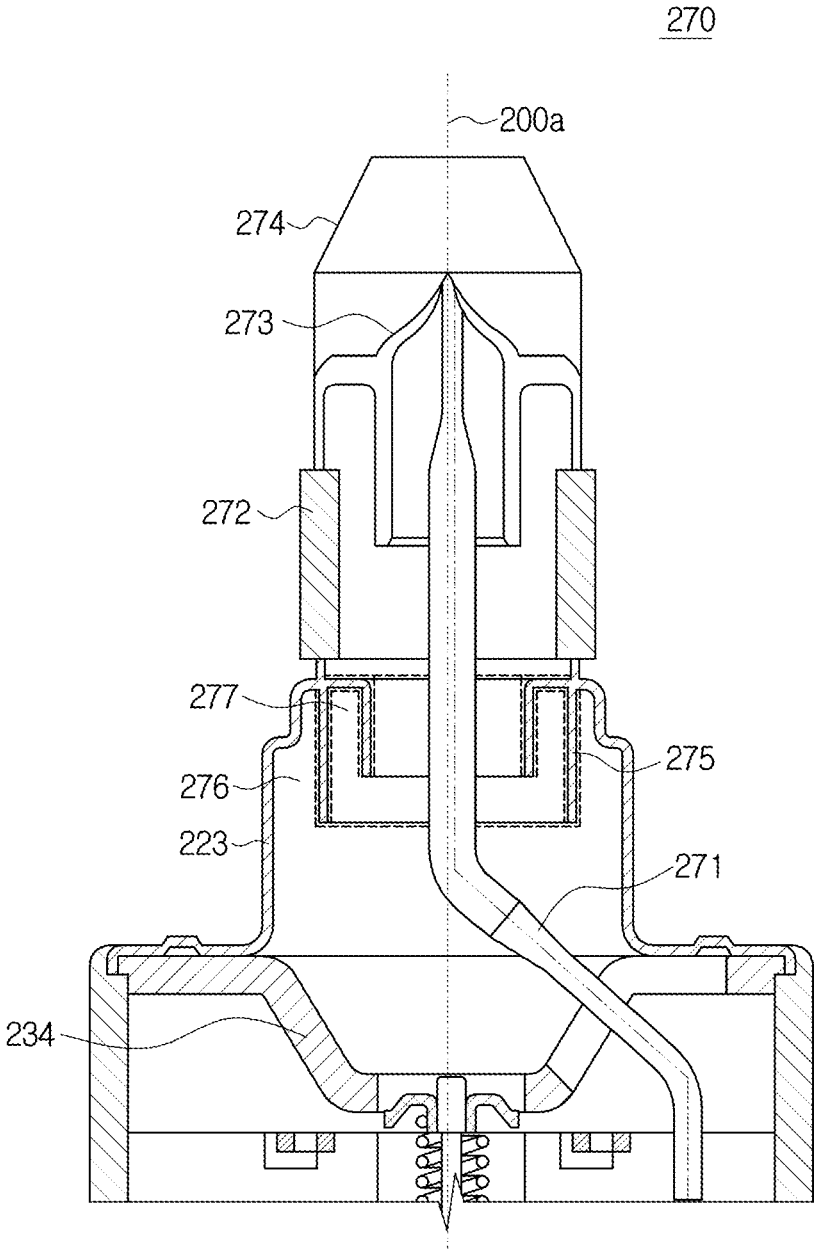
FIG. 13 is a detailed view illustrating an output unit included in the magnetron in accordance with the embodiment of FIG. 2.

FIG. 13 is a detailed view illustrating the output unit 270 included in the magnetron in accordance with the embodiment of FIG. 2.

The output unit 270 further includes a plurality of noise removers 276 and 277.

The first sealing member 223 is formed of an iron plate having a thickness of approximately 0.4~0.5 mm as a base metal, and both the first sealing member 223 and the first pole piece 234 are subjected to a surface treatment, such as nickel plating with a thickness of approximately 2~5 μm.

The output unit 270 includes a dual coaxial cylindrical metal body 275 for a noise remover structure, which is located in the first sealing member 223 at a position proximate to the outer periphery of the second insulator 272 to surround the antenna lead 271.

Here, the dual coaxial cylindrical metal body 275 for a noise remover structure is formed by plating an iron plate having a thickness of approximately 0.2~0.3 mm with copper with a thickness of approximately 2~4 μm, the iron plate and the copper plating being dual coaxial cylindrical metals.

Instead of copper, the dual coaxial cylindrical metal body 275 for a noise remover structure may be plated with a high electric conductivity and non-magnetic metal, such as silver, for example, having a thickness equal to or greater than a skin depth (defined as a depth below the surface) with respect to microwaves of 2450 MHz.

As a result of plating the dual coaxial cylindrical metal body 275 for a noise remover structure with high electric conductivity and non-magnetic copper having a thickness equal to or greater than the skin depth based on skin effect, it may be possible to reduce Joule loss due to microwave current flowing through surfaces of the antenna lead 271, the vent tube 272, and the antenna cap 274, which become inner conductors under the skin effect, and the first pole piece 234, the first sealing member 223, and the dual coaxial cylindrical metal body 275 for a noise remover structure, which become outer conductors under the skin effect.

The output unit 270 further includes a first noise remover 276 and a second noise remover 277 as λ/4 type choke structures for restriction of harmonic noise.

Here, the first noise remover 276 is a choke structure for third harmonics and the second noise remover 277 is a choke structure for fifth harmonics.

The skin effect is the tendency of a high-frequency current, such as microwaves, to become distributed within a conductor such that the current density is largest near the surface of the conductor and decreases with greater depths in the conductor. The skin effect causes the effective resistance of the conductor to increase at higher frequencies where the skin depth is smaller, and thus is important for high-frequency circuits.

As an index of the skin effect, the skin depth d, at which the current density has fallen to 1/e of that at the surface (here, the exponential constant e=2.718) may be calculated by the following Equation (1). Based on the calculation, it will be appreciated that the skin depth d is inversely proportional to electrical conductivity σ, frequency f, and permeability μ.

$$d=(2\rho/\omega\mu)^{1/2}=(2/\sigma\phi\mu)^{1/2} \quad (1)$$

where, ρ: resistivity of the conductor, σ: conductivity of the conductor=1/ρ, ω: angular frequency of current=2π×f, and μ: permeability of the conductor.

Meanwhile, resistance R of the conductor is determined by a material's resistivity ρ, a cross sectional area S, and a length L as represented by the following Equation (2). It will be appreciated that the resistance R decreases as the cross sectional area increases and the resistivity decreases under the same length.

$$R=\rho L/S \quad (2)$$

Resonance sharpness Q of a λ/4 choke structure in the form of a cavity resonator for harmonics may be calculated by the following Equation (3). It will be appreciated that resonance sharpness Q may increase as resistance of a region, through which microwave current flows, decreases and energy consumption due to Joule loss decreases, resulting in decreased deterioration of microwave power.

$$Q=\omega W/P=\omega \text{ circuit cumulative energy/circuit energy consumption} \quad (3)$$

Here, with respect to a main material used as a base metal and plating in a vacuum tube, the skin depth d for each frequency of 2450 MHz (basic harmonics), 7350 MHz (third harmonics), and 12250 MHz (fifth harmonics) may be calculated as follows using the above Equation (1).

| | Conductivity | Resistivity | Permeability | Skin Depth d (μm) | | |
|---|---|---|---|---|---|---|
| Material | $\sigma \times 10^7$ (S/m) | $\rho \times 10^{-8}$ (Ω m) | $\mu \times 10^{-7}$ (H/m) | 2450 MHz | 7350 MHz | 12250 MHz |
| Nickel | 1.38 | 7.24 | 600 × 4π | 0.11 | 0.06 | 0.05 |
| Iron | 1.02 | 9.80 | 2000 × 4π | 0.07 | 0.04 | 0.03 |
| Copper | 5.81 | 1.72 | 4π | 1.33 | 0.77 | 0.59 |
| Silver | 6.17 | 1.62 | 4π | 1.30 | 0.75 | 0.58 |

As represented in the above Table, microwave current flows at a shallow depth of 0.11 μm (2450 MHz), 0.06 μm (7350 MHz), and 0.05 μm (12250 MHz) from a surface of a conventional nickel plating, and flows at a depth of 1.33 μm (2450 MHz), 0.06 μm (7350 MHz), and 0.05 μm (12250 MHz) from a surface of a copper plating having a thickness of 2~4 μm according to the present embodiment. Thus, it will be appreciated that microwave current flows in an expanded cross sectional area of the copper plating approximately 12 times of that in the nickel plating, and substantially does not flow through the base metal.

In addition, when comparing skin resistance of the conventional nickel plating having a thickness of approximately 2~4 μm and the copper plating of the present embodiment having a thickness of approximately 2~4 μm from Equation (2), it will be appreciated that resistance of the nickel plating is approximately 53 times that of the copper plating (because the nickel plating has resistivity of 4.2 times (7.24/1.72) and cross section of 0.08 time (0.11/1.33) those of the copper plating) and the nickel plating has greater Joule loss than the copper plating under the flow of microwave current.

Figure 15:
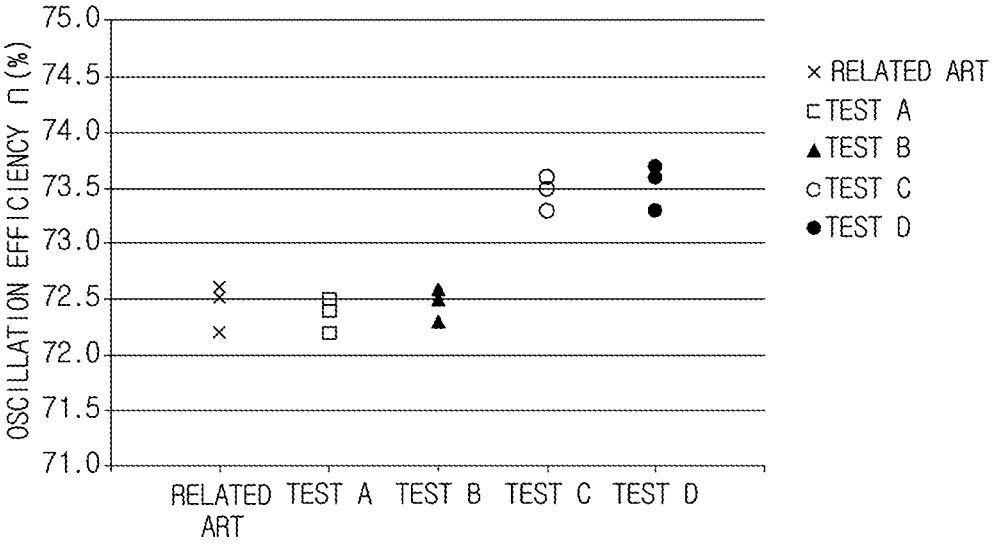

FIGS. 14 and 15 show 3 measured results of oscillation efficiency variation with respect to four tests A to D in which a surface treatment material of each of the dual coaxial cylindrical metal body 275 for a noise remover structure, the first sealing member 223, and the first pole piece 234, which constitute a return path of microwave current generated by microwave power, is changed from nickel plating to copper plating.

As exemplarily shown in FIGS. 14 and 15, in the tests C and D in which the dual coaxial cylindrical metal body 275 for a noise remover structure is plated with copper, oscillation efficiency is increased by approximately 1%, but this effect is not found with regard to the first sealing member 223 and the first pole piece 234.

Consequently, with respect to the dual coaxial cylindrical metal body 275 for a noise remover structure, the first sealing member 223, and the first pole piece 234, which are outer conductors defining a return path of microwave current, it will be appreciated that an excessive energy region in standing waves, caused via interference between advancing microwaves and reflected waves, coincides with a position of the dual coaxial cylindrical metal body 275 for a noise remover structure.

Figure 16:
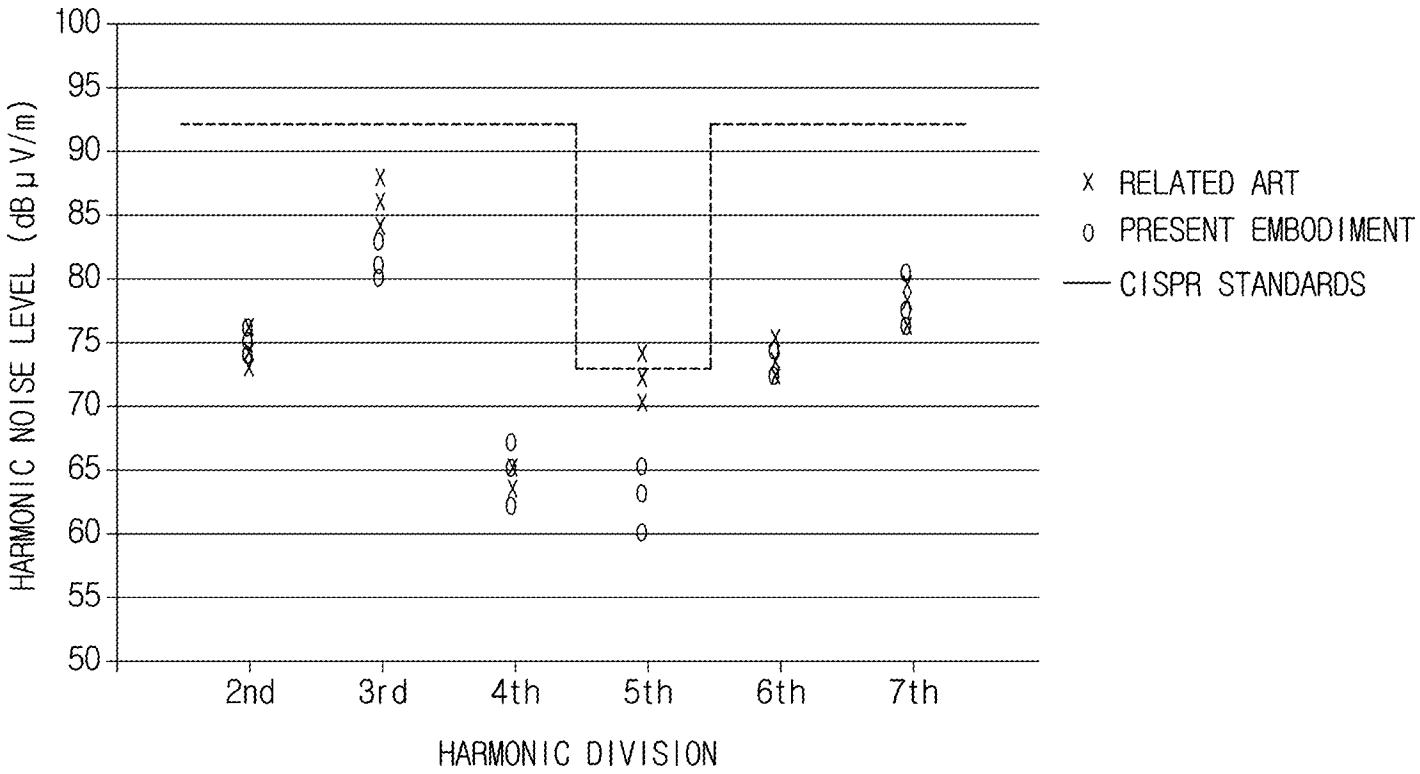
FIG. 16 is a graph of harmonic noise levels of a nickel-plated first noise remover of a conventional magnetron and a copper-plated first noise remover of the magnetron in accordance with the embodiment of FIG. 2.

FIG. 16 is a graph of harmonic noise levels of a nickel-plated dual coaxial cylindrical metal body for a noise remover structure and a copper-plated first noise remover.

More specifically, the graph shows harmonic noise levels of a conventional nickel-plated dual coaxial cylindrical metal body for a noise remover structure and the copper-plated dual coaxial cylindrical metal body 275 for a noise remover structure in accordance with the present embodiment, both of which include the choke structures for third harmonics and fifth harmonics.

Meanwhile, measurement was based on international noise standards, i.e. CISPR (International Special Committee on Radio Interference).

As exemplarily shown in FIG. 16, it will be appreciated that the noise level is reduced by approximately 5 dB at third harmonics and by approximately 10 dB at fifth harmonics.

The λ/4 type harmonic choke configuration in consideration of the skin effect of microwave current may improve harmonic noise restriction and oscillation efficiency, and may reduce noise.

As is apparent from the above description, a magnetron according to the embodiment may achieve higher and more stabilized efficiency, restrict oscillation efficiency variation depending on load variation, and reduce energy consumption.

Further, load stability (MoB) may be improved without deterioration of oscillation efficiency that is important for the magnetron.

Furthermore, specifying a material of a λ/4 type choke structure to restrict unnecessary harmonic noise generated in an output unit of the magnetron may reduce skin resistance due to the skin effect, which may restrict harmonic noise and deterioration of oscillation efficiency.

Although the embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A magnetron comprising:

a yoke;

an anode unit comprising an anode cylinder placed in the yoke and having a working space, a plurality of vanes radially arranged about an axis of the working space, and a first pole piece and a second pole piece respectively installed at both sides of the anode cylinder;

a cathode unit placed in the working space and having a filament spaced apart from the plurality of vanes; and an output unit having an antenna lead connected to a vane among the plurality of vanes to radiate high-frequency microwaves generated by the anode unit and the cathode unit to the outside of the yoke, wherein the first pole piece of the anode unit comprises a first flat portion, a slope formed at an inner side of the first flat portion, a second flat portion formed at an inner side of the slope and having a diameter from 9.5 mm to 10.5 mm, a first hole formed in a center of the second flat portion at a position corresponding to the working space and having a diameter from 8 mm to 8.2 mm, and a second hole formed in the slope for penetration of the antenna lead, wherein the second pole piece of the anode unit comprises a first flat portion, a slope formed at an inner side of the first flat portion, a second flat portion formed at an inner side of the slope and having a diameter different from the diameter of the second flat portion of the first pole piece, and the first hole formed in the center of the second flat portion at the position corresponding to the working space and having a diameter different from the diameter of the first hole of the first pole piece.

2. The magnetron according to claim 1, wherein each of the plurality of vanes has a height from 7.9 mm to 8.1 mm.

3. The magnetron according to claim 1, wherein a diameter of an inscribed circle defined by the radially arranged plurality of vanes is from 8.0 mm to 8.2 mm.

4. The magnetron according to claim 1, wherein the filament has a coil form, and an outer diameter of the filament is from 3.6 mm to 3.8 mm.

5. The magnetron according to claim 1, wherein a distance between the antenna lead and an end of the vane to which the antenna lead is mounted is from 6.8 mm to 7.2 mm.

6. The magnetron according to claim 1, wherein the diameter of the second flat portion of the second pole piece is 10.5 mm to 11.5 mm, and wherein the diameter of the first hole of the second pole piece is 8.4 mm to 8.6 mm.

7. A magnetron comprising:

a yoke;

an anode unit comprising an anode cylinder placed in the yoke and having a working space, a plurality of vanes radially arranged about an axis of the working space, and a first pole piece and a second pole piece respectively installed at both sides of the anode cylinder;

a cathode unit placed in the working space and having a filament spaced apart from the plurality of vanes;

an output unit having an antenna lead connected to any one vane among the plurality of vanes to transmit high-frequency microwaves generated by the anode unit and the cathode unit to the outside of the yoke;

an input unit having an input terminal connected to the cathode unit to supply power to the cathode unit; and a filter unit having a filter box to cover the input unit, a condenser penetrating the filter box, and a plurality of filters arranged in the filter box and connected between the condenser and the input unit, wherein each of the plurality of filters comprises a choke coil, and wherein the choke coil comprises a magnetic substance core having a diameter of 4.0±0.2 mm and a length of 15 mm, a first coil and a second coil wound around the magnetic substance core, a first connection portion connecting the first coil and the second coil to each other, a third coil connected to the second coil, a fourth coil located at one side of the third coil, and a second connection portion connecting the third coil and the fourth coil to each other.

8. A high-frequency heating apparatus using high-frequency microwaves generated by a magnetron, wherein the magnetron comprises:

a yoke;

a cathode unit placed in the yoke and having a filament to discharge thermo-electrons by being heated upon receiving power;

an anode unit comprises an anode cylinder placed in the yoke and having a working space in which an electric field is created, a plurality of vanes radially arranged about an axis of the working space and spaced apart from the filament to generate a group of electrons using the thermo-electrons, and a first pole piece and a second pole piece respectively installed at both sides of the anode cylinder;

a first magnet and a second magnet placed in the yoke at both ends of the anode unit, respectively, to generate a magnetic field; and an output unit having an antenna lead connected to any one vane among the plurality of vanes to transmit high-frequency microwaves generated via rotation of the group of electrons under the influence of the magnetic field and the electric field to the outside of the yoke, wherein the first pole piece of the anode unit comprises a first flat portion, a slope formed at an inner side of the first flat portion, a second flat portion formed at an inner side of the slope and having a diameter from 9.5 mm to 10.5 mm, a first hole formed in the second flat portion at a position corresponding to the working space and having a diameter from 8 mm to 8.2 mm, and a second hole formed in the slope for penetration of the antenna lead, wherein the second pole piece of the anode unit comprises a first flat portion, a slope formed at an inner side of the first flat portion, a second flat portion formed at an inner side of the slope and having a diameter different from the diameter of the second flat portion of the first pole piece, and the first hole formed in a center of the second flat portion at the position corresponding to the working space and having a diameter different from the diameter of the first hole of the first pole piece.

9. The apparatus according to claim 8, wherein each of the vanes has a height from 7.9 mm to 8.1 mm, and wherein a diameter of an inscribed circle defined by the radially arranged vanes is from 8.0 mm to 8.2 mm.

10. The apparatus according to claim 8, wherein the filament has a coil form, and an outer diameter of the filament is from 3.6 mm to 3.8 mm.

11. The apparatus according to claim 8, wherein a distance between the antenna lead and an end of the vane to which the antenna lead is mounted is from 6.8 mm to 7.2 mm.

12. The apparatus according to claim 8, wherein the diameter of the second flat portion of the second pole piece is 10.5 mm to 11.5 mm, and wherein the diameter of the first hole of the second pole piece is 8.4 mm to 8.6 mm.

13. The apparatus according to claim 12, wherein a distance between the second flat portion of the first pole piece and a vane among the plurality of vanes and a distance between the second flat portion of the second pole piece and the vane are from 1.3 mm to 1.5 mm.

14. The apparatus according to claim 8, wherein the cathode unit further comprises a first end hat and a second end hat respectively coupled to both ends of the filament, wherein an outer diameter of each of the first end hat and the second end hat is 7.2 mm, and wherein a distance between the first end hat and the second end hat is 9.0 mm.

15. The apparatus according to claim 8, wherein the magnetron further comprises:

an input unit having an input terminal connected to the cathode unit to supply power to the cathode unit; and a filter unit having a filter box to cover the input unit, a condenser penetrating the filter box, and a plurality of filters in the form of choke coils arranged in the filter box and connected between the condenser and the input unit, wherein each of the choke coils comprises a magnetic substance core having a diameter of 4.0±0.2 mm and a length of 15.0±0.5 mm, a first coil and a second coil wound around the magnetic substance core, a first connection portion connecting the first coil and the second coil to each other, a third coil connected to the second coil, a fourth coil located at one side of the third coil, and a second connection portion connecting the third coil and the fourth coil to each other.

16. The apparatus according to claim 15, wherein the first coil and the second coil are core type dense coils, the third coil is an air core type dense coil, and the fourth coil is an air core type sparse coil, and wherein the first coil has 4 turns, the first connection portion has 1 turn, the second coil has 3 turns, the third coil has 2 turns, the second connection portion has 1 turn, and the fourth coil has 2.5 to 3 turns.

17. The apparatus according to claim 15, wherein an inner diameter of the choke coil is 4.5±0.2 mm.

18. The apparatus according to claim 8, wherein the output unit further comprises a first noise remover arranged around the antenna lead and provided as a choke for third harmonics, and a second noise remover provided as a choke for fifth harmonics, and wherein the first noise remover is formed by plating an iron plate having a thickness from 0.2 mm to 0.3 mm with copper having a thickness of 2 μm to 4 μm.

* * * * *